US012628999B2

(12) United States Patent
Paintner et al.

(10) Patent No.: US 12,628,999 B2
(45) Date of Patent: May 19, 2026

(54) SYSTEM WITH A WATER-BEARING HOUSEHOLD APPLIANCE AND METHOD FOR OPERATING A WATER-BEARING HOUSEHOLD APPLIANCE

(71) Applicant: BSH Hausgeräte GmbH, Munich (DE)

(72) Inventors: Kai Paintner, Welden (DE); Kuldeep Narayan Singh, Dillingen a.d. Donau (DE); Michael Rupp, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 26 days.

(21) Appl. No.: 18/835,892

(22) PCT Filed: Nov. 28, 2022

(86) PCT No.: PCT/EP2022/083506
§ 371 (c)(1),
(2) Date: Aug. 5, 2024

(87) PCT Pub. No.: WO2023/160846
PCT Pub. Date: Aug. 31, 2023

(65) Prior Publication Data

US 2025/0151970 A1 May 15, 2025

(30) Foreign Application Priority Data

Feb. 28, 2022 (EP) ..... 22159151

(51) Int. Cl.
*A47L 15/46* (2006.01)
*A47L 15/00* (2006.01)
*A47L 15/42* (2006.01)

(52) U.S. Cl.
CPC ..... *A47L 15/46* (2013.01); *A47L 15/0021* (2013.01); *A47L 15/0063* (2013.01);
(Continued)

(58) Field of Classification Search
None
See application file for complete search history.

(56) References Cited

U.S. PATENT DOCUMENTS 9,743,820 B2 * 8/2017 Beaudet ..... A47L 15/0021
2017/0354305 A1 12/2017 Beaudet
2020/0399813 A1 12/2020 Kessler

FOREIGN PATENT DOCUMENTS

CN 112663282 A 4/2021

OTHER PUBLICATIONS

National Search Report EP 22159151 dated Aug. 8, 2022, 1 page.
International Search Report PCT/EP2022/083506, 1 page, received Aug. 12, 2024.

* cited by examiner

*Primary Examiner* — Eric W Golightly
(74) *Attorney, Agent, or Firm* — Michael E. Tschupp; Andre Pallapies; Brandon G. Braun

(57) ABSTRACT

A system with a water-bearing household appliance includes a control device to execute a certain treatment program from a plurality of treatment programs, each treatment program including a number of sub-programs and a number of water changes and being determined by a number of program parameters. An observation unit provides an observation result by observing execution of the certain treatment program and an interpreter unit provides a reward by interpreting the observation result. A providing unit provides an adapted treatment program by adapting the certain treatment program using a treatment policy and a deep reinforcement learning process. The deep reinforcement learning process includes the reward as an input. A receiver unit receives the adapted treatment program and provides the adapted treatment program to the control device for execution of the adapted treatment program.

15 Claims, 5 Drawing Sheets

(52) U.S. Cl.
CPC ..... *A47L 15/4293* (2013.01); *A47L 2501/26* (2013.01); *A47L 2501/30* (2013.01)

SYSTEM WITH A WATER-BEARING HOUSEHOLD APPLIANCE AND METHOD FOR OPERATING A WATER-BEARING HOUSEHOLD APPLIANCE

CROSS-REFERENCES TO RELATED APPLICATIONS

This application is the U.S. National Stage of International Application No. PCT/EP2022/083506, filed Nov. 28, 2022, which designated the United States and has been published as International Publication No. WO 2023/160846 A1 and which claims the priority of European Patent Application, Serial No. 22159151.4, filed Feb. 28, 2022, pursuant to 35 U.S.C. 119 (a)-(d).

The contents of International Application No. PCT/EP2022/083506 and European Patent Application, Serial No. 22159151.4 are incorporated herein by reference in their entireties as if fully set forth herein.

BACKGROUND OF THE INVENTION

The present invention relates to a system with a water-bearing household appliance and to a method for operating a water-bearing household appliance.

Known water-bearing household appliances, for example dishwashers, typically have a number of treatment programs, like cleaning programs or washing programs for washing items, like dishes.

Conventionally, treatment programs are developed for a huge plurality of household appliances. For example, a household appliance manufacturer develops treatment programs and stores the developed treatment programs in a memory of the household appliance. In operation, the user of the household appliance may select one of the predefined and pre-stored treatment programs. But, the users or consumers of household appliances are very different in their habits when using a household appliance. The predefined treatment programs cannot cover these different habits of the plurality of different users, disadvantageously. Moreover, conventional treatment programs are represented by a manually and explicitly generated program code that is particularly generated and delivered during development.

BRIEF SUMMARY OF THE INVENTION

It is one objective of the invention to provide an improved water-bearing household appliance.

According to a first aspect, a system with a water-bearing household appliance, in particular a dishwasher, is suggested. The system comprises:

- a control device for executing a certain treatment program from a plurality of treatment programs, each of the treatment programs having a number of sub-programs and a number of water changes and being determined by a number of program parameters, an observation unit for providing an observation result by observing the execution of the certain treatment program,
- an interpreter unit for providing a reward by interpreting the provided observation result,
- a providing unit for providing an adapted treatment program by adapting the certain treatment program using a treatment policy and a deep reinforcement learning process, said deep reinforcement learning process having the provided reward as an input, and
- a receiver unit for receiving the adapted treatment program and for providing the received adapted treatment program to the control device, wherein the control device is configured to execute the received adapted treatment program.

For example, the water-bearing household appliance is implemented as a dishwasher or a washing machine. The treatment program may be a cleaning program or washing program for washing items. For example, washing items are items to be washed or rinsed, e.g. cutlery, plates, pots and the like.

Advantageously, the present system has the ability to provide adapted treatment programs. Because the present system uses rewards being dependent on observation results and deep reinforcement learning process (DRL), the provided adapted treatment programs are user-specific and user-tailored. In particular, the use of deep reinforcement learning process provides an adapted, intelligent, self-learning and consumer-tailored mechanism for adapting treatment programs. This new type of treatment program, i.e. the adapted treatment program, is no longer generated by empirical procedures, like expert knowledge and trial and error, as such.

Using the present mechanism including deep reinforcement learning, the present self-learning system is able to keep the device process so dynamic that it optimally adapts to the needs of the costumer during use. Using the present scheme, each household appliance may develop independently over its entire product lifetime, in particular it may adapt to specific habits of the place the specific household appliance is used. Deep reinforcement learning (deep RL) combines reinforcement learning (RL) and deep learning.

During executing of the certain treatment program, detergents, e.g. detergent tablets, may be used. The detergents preferably comprise one or more active ingredients for an automatic cleaning or washing process. As will be appreciated by the skilled person, the nature of the active ingredient(s) used in the detergents will vary depending on the desired application. When used inside a dishwasher, the detergents may, for example, comprise an active ingredient performing a dishwasher detergent, rinse aid, machine cleaner or dishwasher deodorizing function or any further additional chemistry which supports the cleaning process, or further physical or chemical processes. In the context of laundry washing machines, the detergents may, for example, comprise an active ingredient performing a laundry detergent or fabric softener function. Suitable active ingredients are known to the skilled person; examples include bleach, bleach activator, bleach catalyst, enzyme, surfactant, builder, pH-adjusting agent, corrosion inhibitor, and fragrance.

According to an embodiment, the deep reinforcement learning process is configured to adapt the treatment policy using the provided reward as input.

According to a further embodiment, the treatment policy includes a vector of treatment results being a function of a vector of operation parameters of the treatment program. In particular, the vector of treatment results may include a plurality of vector components. For example, the vector components include a first vector component for a desired cleaning result, a second vector component for a desired drying result, a third vector component for a desired runtime result, and/or a fourth vector component for a desired energy consumption for the treatment program.

Each of the vector components may include or may be represented by a certain interval. For example, a desired drying result may be represented by the interval 92% to 95%.

According to a further embodiment, the operation parameters of the treatment program include a temperature of the water in a washing chamber of the household appliance, a pump speed of a pump of the household appliance, an amount of water in the washing chamber, a commodities amount of the certain treatment program, particularly including a detergent amount of the certain treatment program, a rinsing agent amount of the certain treatment program, a salt amount of the certain treatment program, and/or a fragrance amount of the certain treatment program, a number of water changes of the water in the washing chamber during the treatment program, a control parameter for the regeneration of the water softener, and/or a control parameter of the share between softened water and tap water.

According to a further embodiment, the adjustable program parameters include a program duration, a cleaning intensity and/or a drying intensity.

According to a further embodiment, the system includes a user interface for adjusting the adjustable program parameters by a user.

According to a further embodiment, the treatment result includes a runtime result, a cleaning result and/or a drying result.

According to a further embodiment, the sub-program steps of the respective treatment program include pre-rinsing, cleaning, rinsing and/or drying. In particular, the sub-program steps are executed sequentially. In embodiments, the sub-program steps of the respective treatment program include at least two different temperatures. In particular, the at least two different temperatures are all above the ambient temperature of the household appliance.

According to a further embodiment, the observation unit is configured to provide the observation result including performance parameters and/or consumption parameters of performance and/or consumption of the household appliance during the execution of the certain treatment program.

In embodiments, the performance parameters include:

- a parameter indicating a cleaning result of the certain treatment program,
- a parameter indicating a drying result of the certain treatment program,
- a parameter indicating a runtime result of the certain treatment program,
- a parameter indicating spots at washing items being washed by the certain treatment program,
- a parameter indicating a hygiene of the certain treatment program,
- a parameter indicating the acoustics of the certain treatment program, and/or
- a parameter indicating a glass corrosion of glass of the washing items.

In embodiments, the consumption parameters particularly include:

- a parameter indicating a power consumption of the certain treatment program,
- a parameter indicating a water consumption of the certain treatment program,
- a parameter indicating a salt consumption of the certain treatment program,
- a parameter indicating a detergent amount of the certain treatment program, and/or
- a parameter indicating a $CO_2$-consumption of the certain treatment program.

According to a further embodiment, the reward includes a runtime reward, a cleaning reward, a drying reward, a reward for removing spots at washing items being washed by the certain treatment program, a reward for a hygiene of the certain treatment program, a reward for the acoustics of the certain treatment program, a reward for a glass corrosion of glass of the washing items, a reward for a power consumption of the certain treatment program, a reward for a water consumption of the certain treatment program, a reward for a detergent amount of the certain treatment program, and/or a reward for a $CO_2$-consumption of the certain treatment program.

According to a further embodiment, the providing unit is configured to provide the adapted treatment program using the treatment policy, the deep reinforcement learning process and environment data for the household appliance.

In embodiments, the environment data include user data associated to the household appliance, sensor data associated to the household appliance, test data generated by testing the household appliance, simulation data generated by simulating the household appliance using a digital twin of the household appliance, and/or environmental data describing a local environment of the household appliance, particularly including temperature and humidity.

According to a further embodiment, the providing unit is configured to provide the adapted treatment program using the observation result provided by the observation unit and a status information indicating a current status of the household appliance additionally. Using this addition information, the provision of adapted treatment programs for a specific user of a specific household appliance may be further improved.

According to a further embodiment, the household appliance includes the control device, the observation unit, the interpreter unit, the providing unit and the receiver unit. In this embodiment, the control device may integrate the observation unit, the interpreter unit, the providing unit and the receiver unit.

According to a further embodiment, the system comprises the household appliance and an agent device being external to the household applicant, wherein the household appliance integrates the control device, the observation unit, the interpreting unit and the receiver unit, and wherein the agent device integrates the providing unit. In this embodiment, the control device of the household appliance may integrate the observation unit, the interpreter unit and the receiver unit.

According to a further embodiment, the system further comprises a checking unit, the checking unit being configured to check if the reward provided by the interpreter unit reaches a first predefined threshold or not, wherein the checking unit is particularly configured to trigger the deep reinforcement learning process with the reward if said reward is below the first predefined threshold.

According to a further embodiment, the checking unit is configured to calculate a ratio between a difference of the provided reward and the first predefined threshold and a number of deep reinforcement learning processes applied to the certain treatment program for determining a progress of learning, wherein the checking unit is further configured to adapt the treatment policy and/or the deep reinforcement learning process, if the calculated ratio is greater than a second predefined threshold. In particular, the second predefined threshold is determined by a threshold function or by a target function.

According to a second aspect, a computer-implemented method for operating a water-bearing household appliance, in particular a dishwasher, is proposed. The method includes:

- executing a certain treatment program from a plurality of treatment programs, each of the treatment programs having a number of sub-programs and a number of water changes and being determined by a number of program parameters, observing the execution of the certain treatment program for providing an observation result, providing a reward by interpreting the provided observation result, providing an adapted treatment program by adapting the certain treatment program using a treatment policy and a deep reinforcement learning process, said deep reinforcement learning process having the provided reward as an input, and executing the adapted treatment program by the household appliance.

In particular, the respective sub-program includes at least one water change.

In embodiments, the step of providing an adapted treatment program may include receiving an adapted treatment program by a receiver unit of the household appliance and transferring the received adapted treatment program to the control device of the household appliance for execution.

The embodiments and features according to the first aspect are also embodiments of the second aspect.

According to a third aspect, a computer program product is proposed, the computer program product comprising machine readable instructions, that when executed by one or more processing units, cause the one or more processing units to perform the method of the second aspect or of any embodiment of the second aspect.

A computer program product, such as a computer program means, may be embodied as a memory card, USB stick, CD-ROM, DVD or as a file which may be downloaded from a server in a network. For example, such a file may be provided by transferring the file comprising the computer program product from a wireless communication network.

According to a fourth aspect, a computer readable medium is proposed on which program code sections of a computer program are saved, the program code sections being loadable into and/or executable in a system to make the system execute the method of the second aspect or of any embodiment of the second aspect when the program code sections are executed in the system.

The embodiments and features according to the first aspect are also embodiments of the fifth aspect.

According to a fifth aspect, a computer-implemented device for operating a water-bearing household appliance, in particular a dishwasher, is proposed, the computer-implemented device comprising:

one or more processing units, and a memory coupled to the one or more processing units, the memory comprising a module configured to perform the method steps of the method of the second aspect or of any embodiment of the second aspect.

The respective unit, for example the processing unit, the observation unit, the interpreter unit and the providing unit, may be implemented in hardware and/or in software. When implemented in hardware, the respective unit may be implemented as a computer, a CPU (central processing unit), an ASIC (application specific integrated circuit) or a PLC (programmable logic controller). When implemented in software, the respective unit may be configured as a computer program product, a function, an algorithm, a routine, as part of a programming code or as an executable object Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

BRIEF DESCRIPTION OF THE DRAWINGS

Further embodiments, features and advantages of the present invention will become apparent from the subsequent description and dependent claims, taken in conjunction with the accompanying drawings, in which:

DETAILED DESCRIPTION OF EXEMPLARY EMBODIMENTS OF THE PRESENT INVENTION

Figure 1:
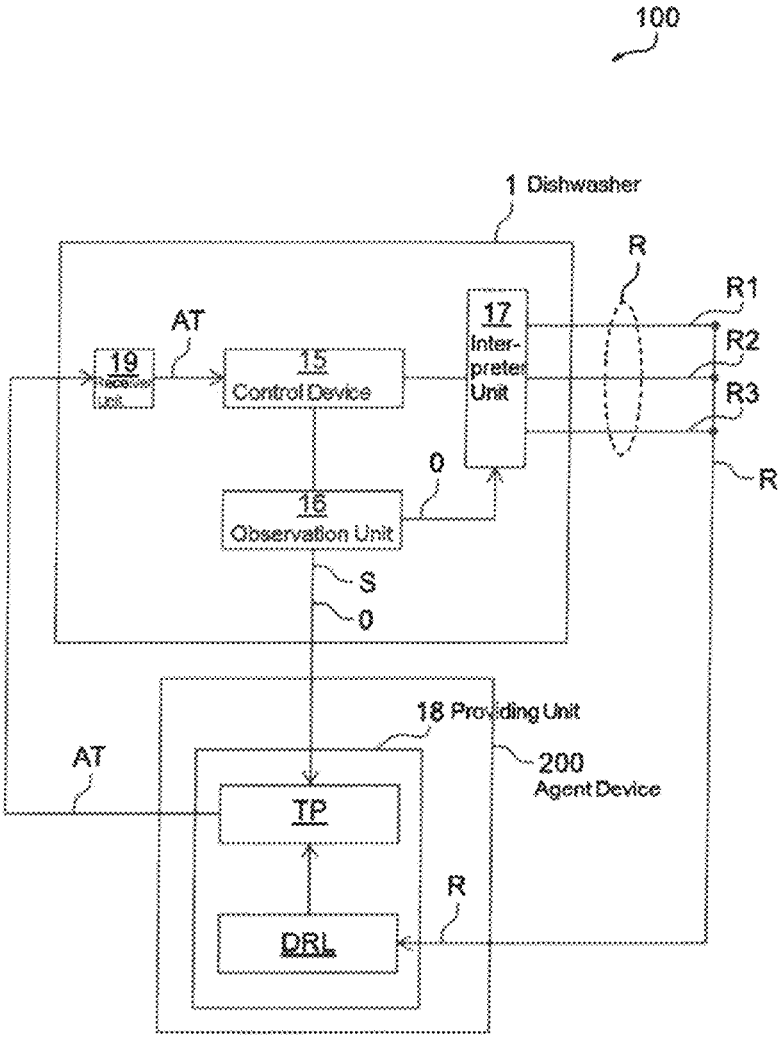
FIG. 1 shows a schematic block diagram of a first embodiment of a system with a water-bearing household appliance.

In the Figures, like reference numerals designate like or functionally equivalent elements, unless otherwise indicated.

Figure 2:
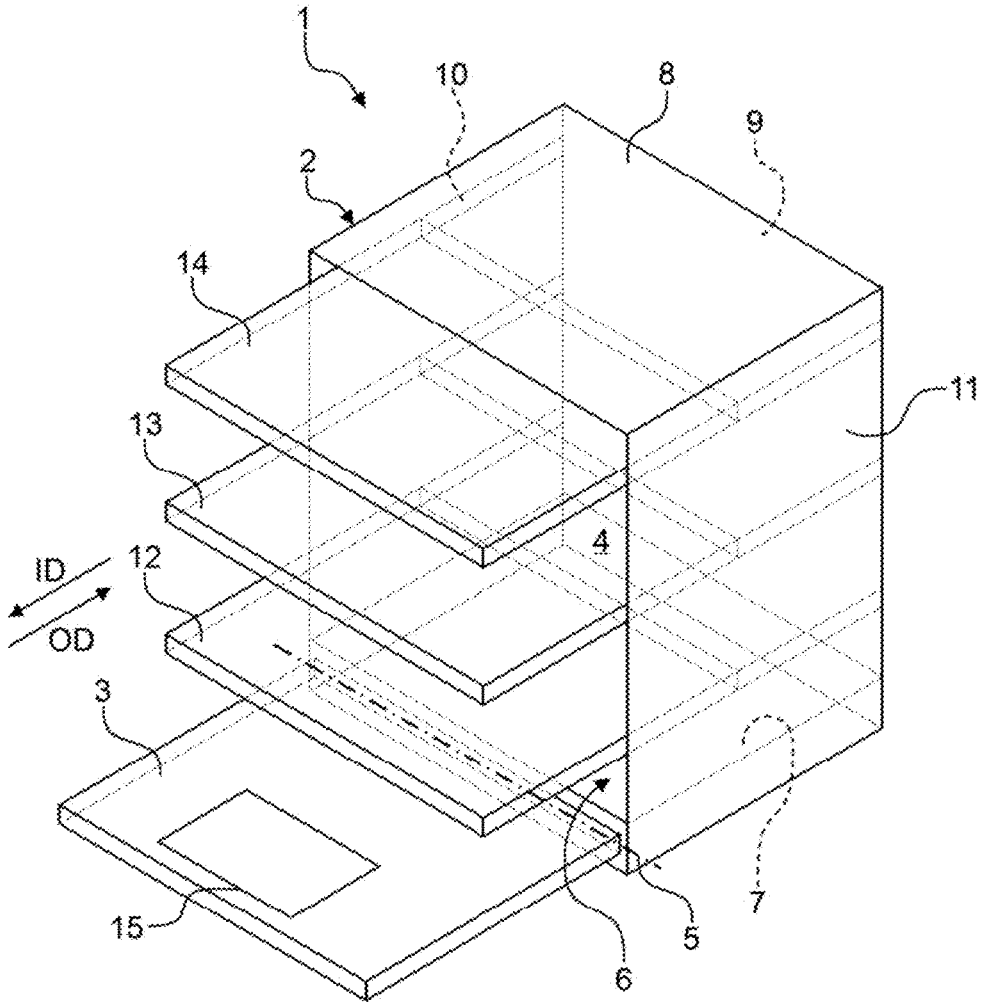
FIG. 2 shows a schematic perspective view of an example of a water-bearing household appliance.

FIG. 1 shows a schematic a block diagram of a first embodiment of a system 100 with a water-bearing household appliance 1, e. g. a dishwasher. Further, FIG. 2 shows a schematic perspective view of an example of a water-bearing household appliance 1, which is implemented as a domestic dishwasher. In the following, FIGS. 1 and 2 are described in conjunction.

The system 100 of FIG. 1 includes a dishwasher 1, a control device 15, an observation unit 16, an interpreter unit 17, a providing unit 18 and a receiver unit 19. In the example of FIG. 1, the dishwasher 1 includes the control device 15, the observation unit 16, the interpreter unit 17 and the receiver unit 19. Moreover, the providing unit 18 is located in an agent device 200 being external to the dishwasher 1. The agent device 200 and the dishwasher 1 may be coupled by a communication network, e.g. including a wireless network and/or the Internet.

The control device 15 is adapted to execute a certain treatment program from a plurality of treatment programs. A treatment program may be a cleaning program or a washing program for washing items. Washing items are items to be washed or rinsed, like cutlery, plates, pots and the like, for example. Each of the treatment programs has a number of sub-programs and a number of water changes. Moreover, the sub-program steps of the respective treatment program particularly include at least two different temperatures. Moreover, the sub-program steps of the respective treatment program include pre-rinsing, cleaning, rinsing and/or drying. In particular, the sub-program steps are executed sequentially.

Moreover, each of the treatment programs is determined by a number of program parameters. The program parameters are particularly adjustable program parameters, wherein a user may adjust them. The adjustable program parameters particularly include a program duration, a cleaning intensity and/or a drying intensity. For adjusting the adjustable program parameters, the system 100 may include a user interface (not shown).

The observation unit 16 may be coupled to the control device 15. The observation unit 16 is adapted to provide an observation result O by observing the execution of the certain treatment program. In particular, the observation unit 16 is adapted to provide the observation result including performance parameters and/or consumption parameters of performance and/or consumption of the dishwasher 1 during the execution of the certain treatment program.

In this regard, the performance parameters may include a parameter indicating a cleaning result of the certain treatment program, a parameter indicating a drying result of the certain treatment program, a parameter indicating a runtime result of the certain treatment program, a parameter indicating spots at washing items being washed by the certain treatment program, a parameter indicating a hygiene of the certain treatment program, a parameter indicating the acoustics of the certain treatment program, and/or a parameter indicating a glass corrosion of glass of the washing items.

Moreover, the consumption parameters particularly include a parameter indicating a power consumption of the certain treatment program, a parameter indicating a water consumption of the certain treatment program, a parameter indicating a detergent amount of the certain treatment program, and/or a parameter indicating a $CO_2$-consumption of the certain treatment program.

The observation unit 16 may be coupled to the interpreter unit 17. The interpreter unit 17 is adapted to provide a reward R by interpreting the provided observation result O. In particular, the reward R includes a runtime reward R1, a cleaning reward R2 and a drying reward R3.

Additionally, the reward R may include a reward for removing spots at washing items being washed by the certain treatment program, a reward for a hygiene of the certain treatment program, a reward for the acoustics of the certain treatment program, a reward for a glass corrosion of glass of washing items, a reward for a power consumption of the certain treatment program, a reward for a water consumption of the certain treatment program, a reward for a detergent amount of the certain treatment program, and/or a reward for a $CO_2$-consumption of the certain treatment program.

The interpreter unit 17 may be coupled to the providing unit 18. The providing unit 18 is configured to provide an adapted treatment program AT by adapting the certain treatment program using a treatment policy TP and a deep reinforcement learning process DRL, said deep reinforcement learning DRL having the provided reward R as input. In particular, the deep reinforcement learning process DRL is configured to adapt the treatment policy TP using the provided reward R as input. The treatment policy TP may include a vector of treatment results being a function of a vector of operation parameters of the treatment program. In particular, the vector of treatment results may include a plurality of vector components. For example, the vector components may include a first vector component for a desired cleaning result, a second vector component for a desired drying result, a third vector component for a desired runtime result, and/or a fourth vector component for a desired energy consumption for the treatment program. The treatment result may include a runtime result, a cleaning result and/or a drying result.

Moreover, the operation parameters of the treatment program may include the temperature of the water in a washing chamber 4 (see FIG. 2) of the dishwasher 1, a pump speed of a pump of the dishwasher 1, an amount of water in the washing chamber 4, a commodities amount of the certain treatment program, particularly including a detergent amount of the certain treatment program, a rinsing agent amount of the certain treatment program, a salt amount of the certain treatment program, and/or a fragrance amount of the certain treatment program, and/or a number of water changes of the water in the washing chamber 4 during the treatment program.

In particular, the providing unit 18 is configured to provide the adapted treatment program AT using the treatment policy TP, the deep reinforcement learning process DRL and environment data for the dishwasher 1. In particular, the environment data includes user data associated to the dishwasher 1, sensor data associated to the dishwasher 1, test data generated by testing the dishwasher 1, simulation data generated by simulating the dishwasher 1 using a digital twin of the dishwasher 1, and/or environmental data describing a local environment of the dishwasher 1. For example, the environmental data includes temperature and humidity.

The providing unit 18 is coupled, in particular temporarily coupled, to the receiver unit 19. The receiver unit 19 is configured to receive the adapted treatment program AT. Moreover, the receiver unit 19 provides the received adapted treatment program AT to the control device 15. Then, the control device 15 executes the received adapted treatment program AT.

In embodiments, as exemplarily shown in FIG. 1, the providing unit 18 is external to the dishwasher 1. In other embodiments, the control device 15, the observation unit 16, the interpreter unit 17, the providing unit 18 and the receiver unit 19 are all part of the dishwasher 1. An example for an embodiment where the dishwasher 1 includes the control device 15, the observation unit 16, the interpreter unit 17, the providing unit 18 and the receiver unit 19 is shown in FIG. 2. Moreover, in FIG. 2, the control device 15 integrates the further units, i.e. the observation unit 16, the interpreter unit 17, the provider 18 and the receiver unit 19. For this reason, only the control device 15 is depicted in FIG. 2.

Further, the domestic dishwasher 1 of FIG. 2 comprises a tub 2, which can be closed by a door 3. Preferably, the door 3 seals the tub 2 so that it is waterproof, for example by using a door seal between door 3 and the tub 2. Preferably, the tub 2 has a cuboid shape. Tub 2 and door 3 can form a washing chamber 4 for washing dishes.

In FIG. 2, door 3 is shown in the open position. By swiveling about an axis 5 at a lower edge of door 3, the door 3 can be opened or closed. With the door 3, an opening 6 of the tub 2 for inserting dishes into the washing chamber 4 can be opened or closed. Tub 2 comprises a lower cover 7, an upper cover 8 facing the lower cover 7, a rear cover 9 facing the closed door 3 and two side covers 10, 11 which face each other. For example, the lower cover 7, the upper cover 8, the rear cover 9 and the two side covers 10, 11 can be made from stainless steel sheets. Alternatively, at least one of the covers, for example the lower cover 7, can be made from a polymeric material, such as plastic.

The domestic dishwasher 1 further has at least one rack 12, 13, 14 on which dishes to be washed can be placed. Preferably, more than one rack 12, 13, 14 is used, wherein rack 12 can be lower rack, rack 13 can be an upper rack and rack 14 can be a rack specific for cutlery. As is shown in FIG. 2, the racks 12 to 14 are arranged vertically above each other in the tub 2. Each rack 12, 13, 14 can be pulled out from the tub 2 in a first, outward direction OD or pushed into the tub 2 in a second, inward direction ID.

Figure 3:
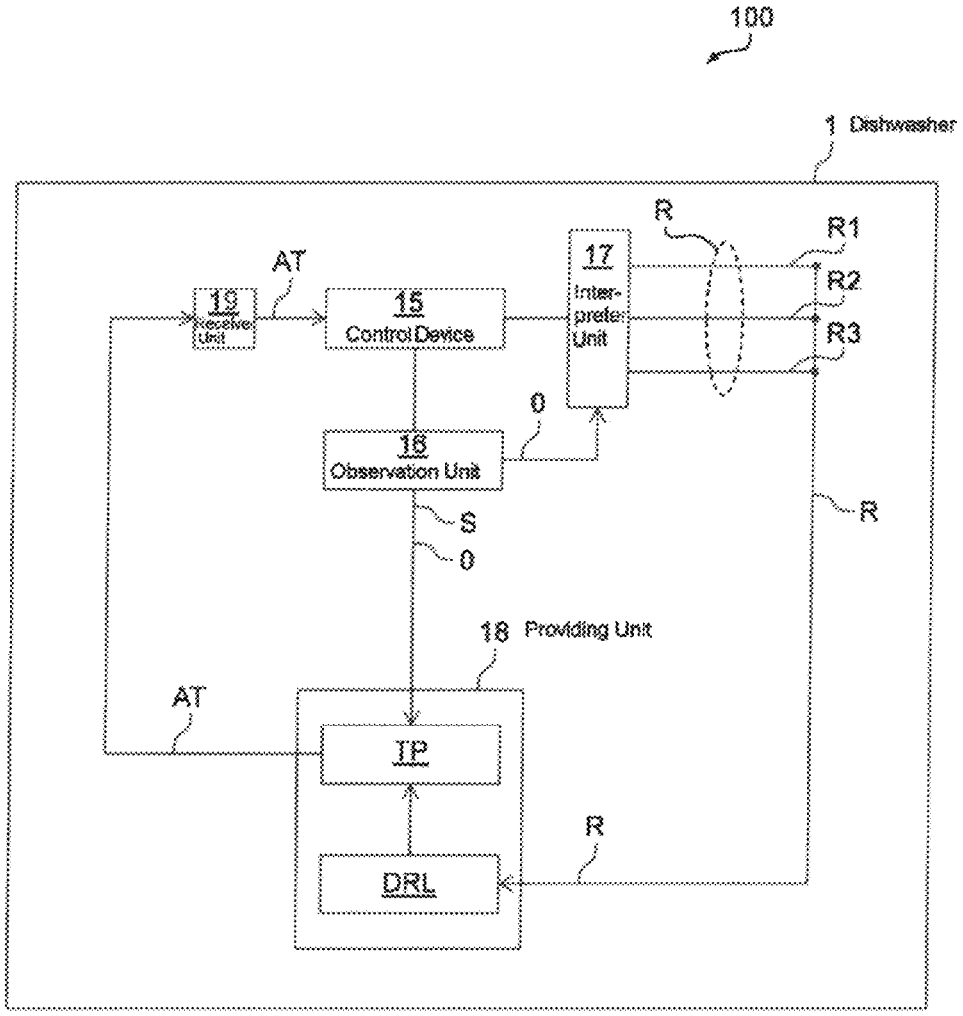
FIG. 3 shows a schematic block diagram of a second embodiment of a system with a water-bearing household appliance.

Furthermore, FIG. 3 shows a schematic block diagram of a second embodiment of a system 100 with a water-bearing household appliance 1, e. g. a dishwasher. The second embodiment of FIG. 3 is based on the first embodiment of FIG. 1, and the only difference to FIG. 1 is that the second embodiment of FIG. 3 has no external agent device 200, because the providing unit 18 is part of the dishwasher 1. Thus, the second embodiment of FIG. 3 has a dishwasher 1 including the control device 15, the observation unit 16, the interpreter unit 17, the providing unit 18 and the receiver unit 19, their functionalities are described with reference to FIGS. 1 and 2 and are here omitted to avoid repetitions.

Figure 4:
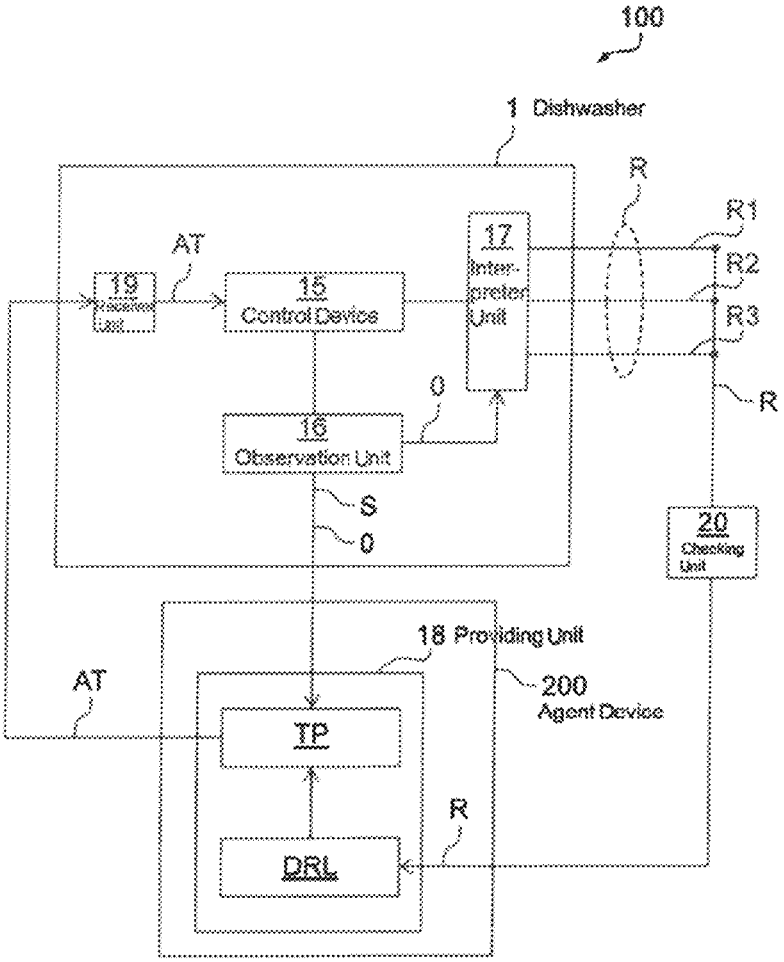
FIG. 4 shows a schematic block diagram of a third embodiment of a system with a water-bearing household appliance.

FIG. 4 shows a schematic block diagram of a third embodiment of a system 100 with a water-bearing household appliance 1, e. g. a dishwasher. The third embodiment of FIG. 4 corresponds to that of FIG. 1 and additionally includes a checking unit 20. The checking unit 20 is coupled between the interpreter unit 17 and the providing unit 18, which is exemplarily part of the agent device 200 in FIG. 4. The checking unit 20 may be also integrated in the second embodiment of FIG. 3.

The checking unit 20 is configured to check if the reward R provided by the interpreter unit 17 reaches a first predefined threshold or not. If said reward R is below the first predefined threshold, the checking unit 20 triggers the deep reinforcement learning process DRL with the reward R.

Moreover, the checking unit 20 may calculate a ratio between a difference of the provided reward R and the first predefined threshold and a number of deep reinforcement learning processes DRL applied to the certain treatment program for determining a progress of learning. The checking unit 20 is further configured to adapt the treatment policy TP and/or the deep reinforcement learning process DRL, if the calculated ratio is greater than a second predefined threshold.

Figure 5:
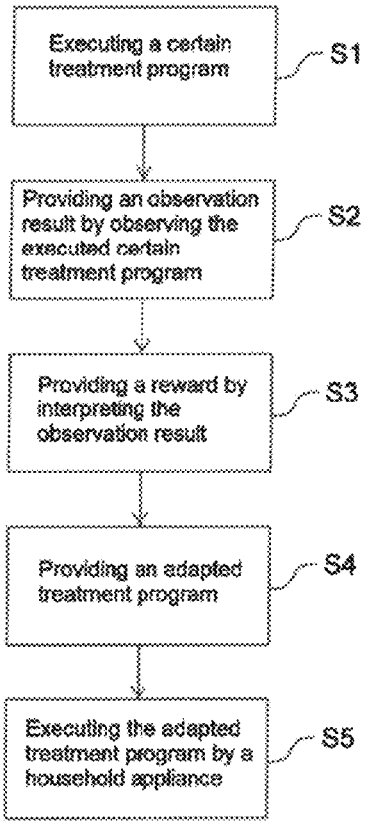
FIG. 5 shows a flowchart of an embodiment of a computer-implemented method for operating a water-bearing household appliance.

FIG. 5 shows a flowchart of an embodiment of a computer-implemented method for operating a water-bearing household appliance 1. Embodiments for such a water-bearing household appliance 1 are shown in FIGS. 1 to 4. The method of FIG. 5 comprises steps S1 to S5.

In step S1, a certain treatment program from a plurality of treatment programs is executed, each of the treatment programs having a number of sub-programs and a number of water changes and is determined by a number of program parameters.

In step S2, the execution of the certain treatment program is observed for providing an observation result O.

In step S3, a reward R is provided by interpreting the provided observation result O.

In step S4, an adapted treatment program AT is provided by adapting the certain treatment program using a treatment policy TP and a deep reinforcement learning process DRL. The deep reinforcement learning process DRL has the provided reward R as an input.

In step S5, the adapted treatment program AT is executed by the household appliance 1.

In embodiments, the step S4 of providing an adapted treatment program AT may include receiving an adapted treatment program AT by the receiver unit 19 of the household appliance 1 and transferring the received adapted treatment program AT to the control device 15 of the household appliance 1 for execution.

Although the present invention has been described in accordance with preferred embodiments, it is obvious for the person skilled in the art that modifications are possible in all embodiments.

The invention claimed is:

1. A system with a water-bearing household appliance, in particular a dishwasher, the system comprising:

a control device designed to execute a certain treatment program from a plurality of treatment programs, each of the plurality of treatment programs including a number of sub-programs and a number of water changes and being determined by a number of program parameters;

an observation unit designed to provide an observation result by observing execution of the certain treatment program;

an interpreter unit designed to provide a reward by interpreting the observation result;

a providing unit designed to provide an adapted treatment program by adapting the certain treatment program using a treatment policy and a deep reinforcement learning process, said deep reinforcement learning process including the reward as an input and configured to adapt the treatment policy using the reward as input; and a receiver unit designed to receive the adapted treatment program and to provide the adapted treatment program to the control device, wherein the control device is designed to execute the adapted treatment program.

2. The system of claim 1, wherein the treatment policy includes a vector of treatment results being a function of a vector of operation parameters of the certain treatment program.

3. The system of claim 2, wherein the operation parameters of the treatment program include a temperature of water in a washing chamber of the household appliance, a pump speed of a pump of the household appliance, an amount of water in the washing chamber, a commodities amount of the certain treatment program, particularly including a detergent amount of the certain treatment program, a rinsing agent amount of the certain treatment program, a salt amount of the certain treatment program, and/or a fragrance amount of the certain treatment program, a number of water changes of the water in the washing chamber during the treatment program, a control parameter for regeneration of a water softener and/or a control parameter of a share between softened water and tap water.

4. The system of claim 1, wherein the program parameters are adjustable program parameters which include a program duration, a cleaning intensity and/or a drying intensity, the system further comprising a user interface designed to adjust the adjustable program parameters by a user.

5. The system of claim 2, wherein the treatment results include a runtime result, a cleaning result and/or a drying result.

6. The system of claim 1, wherein the sub-programs of each of the treatment programs include pre-rinsing, cleaning, rinsing and/or drying and are executed sequentially, wherein the sub-programs of each of the treatment programs particularly include at least two different temperatures.

7. The system of claim 1, wherein the observation unit is designed to provide the observation result including performance parameters and/or consumption parameters of performance and/or consumption of the household appliance during execution of the certain treatment program, wherein the performance parameters particularly include:

a parameter indicating a cleaning result of the certain treatment program, a parameter indicating a drying result of the certain treatment program, a parameter indicating a runtime result of the certain treatment program, a parameter indicating spots at washing items being washed by the certain treatment program, a parameter indicating a hygiene of the certain treatment program, a parameter indicating the acoustics of the certain treatment program, and/or a parameter indicating a glass corrosion of glass of the washing items, and/or wherein the consumption parameters particularly include:

a parameter indicating a power consumption of the certain treatment program, a parameter indicating a water consumption of the certain treatment program, a parameter indicating a salt consumption of the certain treatment program, a parameter indicating a detergent amount of the certain treatment program, and/or a parameter indicating a CO2-consumption of the certain treatment program.

8. The system of claim 1, wherein the reward includes a runtime reward, a cleaning reward, a drying reward, a reward for removing spots at washing items being washed by the certain treatment program, a reward for a hygiene of the certain treatment program, a reward for acoustics of the certain treatment program, a reward for a glass corrosion of glass of the washing items, a reward for a power consumption of the certain treatment program, a reward for a water consumption of the certain treatment program, a reward for a detergent amount of the certain treatment program, and/or a reward for a CO2-consumption of the certain treatment program.

9. The system of claim 1, wherein the providing unit is designed to provide the adapted treatment program using the treatment policy, the deep reinforcement learning process and environment data for the household appliance, wherein the environment data particularly include user data associated to the household appliance, sensor data associated to the household appliance, test data generated by testing the household appliance, simulation data generated by simulating the household appliance using a digital twin of the household appliance, and/or environmental data describing a local environment of the household appliance, particularly including temperature and humidity.

10. The system of claim 1, wherein the control device, the observation unit, the interpreter unit, the providing unit and the receiver unit are integrated in the household appliance.

11. The system of claim 1, further comprising:

the household appliance designed to integrate the control device, the observation unit, the interpreting unit and the receiver unit; and an agent device being external to the household applicant and designed to integrate the providing unit.

12. The system of claim 1, further comprising a checking unit designed to check if the reward provided by the interpreter unit reaches a first predefined threshold or not and to trigger the deep reinforcement learning process with the reward if the reward is below the first predefined threshold.

13. The system of claim 12, wherein the checking unit is designed to calculate a ratio between a difference of the reward and the first predefined threshold and a number of deep reinforcement learning processes applied to the certain treatment program for determining a progress of learning, wherein the checking unit is designed to adapt the treatment policy and/or the deep reinforcement learning process, if the calculated ratio is greater than a second predefined threshold.

14. A computer-implemented method for operating a water-bearing household appliance, in particular a dishwasher, the computer-implemented method comprising:

executing, by a control device of the dishwasher, a certain treatment program from a plurality of treatment programs, each of the treatment programs including a number of sub-programs and a number of water changes and being determined by a number of program parameters, observing, by an observation unit of the dishwasher, execution of the certain treatment program for providing an observation result, providing, by an interpreter unit of the dishwasher, a reward by interpreting the observation result, providing, by a providing unit, an adapted treatment program by adapting the certain treatment program using a treatment policy and a deep reinforcement learning process, with the deep reinforcement learning process including the reward as an input and adapting the treatment policy using the reward as input receiving the adapted treatment program by a receiver unit designed to receive the adapted treatment program and to provide the adapted treatment program to the control device, wherein the control device is designed to execute the adapted treatment program, and executing the adapted treatment program by the control device of the dishwasher.

15. A computer program product for operating a water-bearing household appliance, in particular a dishwasher, the computer program product embodied on a non-transitory computer readable medium comprising machine readable instructions, that when executed by at least one processing unit of the dishwasher, causes the to perform operations comprising:

executing, by a control device of the dishwasher, a certain treatment program from a plurality of treatment programs of the dishwasher, each of the treatment programs including a number of sub-programs and a number of water changes and being determined by a number of program parameters, observing, using an observation unit of the dishwasher, execution of the certain treatment program for providing an observation result, providing, using an interpreter unit of the dishwasher, a reward by interpreting the observation result, providing, by a providing unit, an adapted treatment program by adapting the certain treatment program using a treatment policy and a deep reinforcement learning process, with the deep reinforcement learning process including the reward as an input and adapting the treatment policy using the reward as input receiving the adapted treatment program by a receiver unit designed to receive the adapted treatment program and to provide the adapted treatment program to the control device, wherein the control device is designed to execute the adapted treatment program, and executing the adapted treatment program.

* * * * *